US006676319B2

(12) United States Patent
Werhahn et al.

(10) Patent No.: US 6,676,319 B2
(45) Date of Patent: Jan. 13, 2004

(54) GLUE STICK

(75) Inventors: Wilhelm Werhahn, Baden-Baden (DE); Werner Panter, Oberachern (DE); Hans-Martin Kapsa, Ottersweier (DE)

(73) Assignee: Uhu GmbH & Co, KG, Bühl (DE)

( * ) Notice: Subject to any disclaimer, the term of this patent is extended or adjusted under 35 U.S.C. 154(b) by 0 days.

(21) Appl. No.: 10/075,498

(22) Filed: Feb. 12, 2002

(65) Prior Publication Data

US 2002/0159819 A1 Oct. 31, 2002

(30) Foreign Application Priority Data

Feb. 12, 2001 (CH) ..... 2001 0243/01

(51) Int. Cl.[7] ..... B43K 21/08

(52) U.S. Cl. ..... 401/72; 401/75; 401/77; 401/78; 401/68

(58) Field of Search ..... 401/68, 69, 71, 401/72, 75–78, 86, 88, 98, 172–176

(56) References Cited

U.S. PATENT DOCUMENTS

| | | | | |
|---|---|---|---|---|
| 2,935,191 A | | 5/1960 | Leshin | 206/56 |
| 3,907,441 A | * | 9/1975 | Idec et al. | 401/75 |
| 3,964,832 A | * | 6/1976 | Cohen et al. | 401/75 |
| 4,580,920 A | * | 4/1986 | Schmidt | 401/175 |
| 4,699,161 A | * | 10/1987 | Smith et al. | 401/68 |
| 5,505,041 A | * | 4/1996 | Harlan | 401/68 |
| 6,102,600 A | * | 8/2000 | Bedol | 401/75 |
| 6,186,686 B1 | * | 2/2001 | Neuner et al. | 401/75 |
| 6,447,192 B1 | * | 9/2002 | Butz et al. | 401/75 |
| 6,488,427 B1 | * | 12/2002 | Breidenbach et al. | 401/75 |

FOREIGN PATENT DOCUMENTS

| | | | |
|---|---|---|---|
| DE | 1921937 | 8/1965 | |
| DE | 1511732 | 10/1970 | |
| DE | 2139123 | 2/1973 | B65D/83/14 |

* cited by examiner

*Primary Examiner*—Tuan N. Nguyen
(74) *Attorney, Agent, or Firm*—Janet Sleath; Ann W. Speckman

(57) ABSTRACT

In the outer sleeve there runs a threaded spindle which is mounted in a bearing sleeve (5) and on which a piston (30) is movable up and down. The outer sleeve (1) is in relation to its inner diameter $A_d$ considerably longer than with known glue sticks. The ratio of the inner diameter $A_d$ of the outer sleeve (1) to the length $A_L$ of the part of the outer sleeve which serves for receiving a rod-like adhesive mass (10) here lies in the region of 1:6 to 1:15. This however according to the invention demands that the threaded spindle is configured such that it simultaneously serves as a conveyor worm. Thanks to the special configuration of the piston (30) is spite of the great length of the threaded spindle there is achieved a bending-breakage stabilization.

9 Claims, 2 Drawing Sheets

22
21
20
6
3
9
4
5
7
30
$A_L$
$A_d$
$A_d : A_L = 1:10$
1
4
11
8
2
10

20
12
1
11
8
40
30

GLUE STICK

BACKGROUND OF THE INVENTION

The present invention relates to a glue stick with an outer sleeve open at least at one side, for receiving a rod-like adhesive mass, in said glue stick there being located a threaded spindle which is connected to a rotary cap arranged on one side and being in interactive connection with the spindle.

Glue sticks of this type are on the market and hardly differ in shape and size independently of the manufacturer. For example here in particular the documents DE1511732B, DE1921937U, DE2139123B or U.S. Pat. No. 2,935,191A are referred to.

On the market there are offered glue sticks above all in three formats, with a filled weight of the adhesive mass of approx. 10 grams, 20 grams or 40 grams. The rod-like adhesive mass at the same time is located in the outer sleeve whose inner diameter corresponds to the diameter of the rod-like adhesive mass located therein. The inner diameter of the smaller outer sleeve measures usually about 15 millimeters, the inner diameter of the outer sleeve of the larger variant between 19–24 millimeters. The length of the outer sleeve, which is available for receiving the rod-like adhesive mass is about 40–45 millimeters, whilst the corresponding length with the larger outer sleeve is about 50–65 millimeters. With the glue sticks common today which are obtainable on the market the ratio of the inner diameter of the outer sleeve to the length of the part of the outer sleeve which serves for receiving the rod-like adhesive mass is thus about 1:3. This ratio is on the one hand caused by the consistency of the adhesive mass and on the other hand by the design principle applied up to today. The stunted shape of the glue sticks, that is to say relatively thick and relatively short renders the glue stick unsuitable for its portability and keeping, similar to a ball-point pen or ink pen or other writing utensils. Normally they are kept standing or lying on a table surface. Accordingly the rotary caps form the standing surfaces of the glue sticks.

On account of the shape therefore also small adhesive surfaces are very difficult to be coated with these glue sticks.

As already mentioned the shaping of the outer sleeve is essentially dependent on the consistency of the adhesive mass and the design principle of the glue sticks. The rod-like adhesive mass is on the one hand held in a receiving holder which is part of a piston which by way of a threaded spindle in the outer sleeve is movable up and down. The adhesive mass at the same time contacts the outer sleeve and corresponding adhesion forces occur. Whilst the expulsion of the rod-like adhesive mass is basically also possible with a longer outer sleeve, however the retraction of the rod-like adhesive masses causes a problem. With this the rod-like adhesive mass may be pulled out of the receiving holder of the piston so that the glue stick may no longer be retracted. This may be partly solved technically in that one provides the receiving holder with more heavily projecting radially inwardly directed ribs, but then there still remains a problem. With a larger length or with a ratio of the inner diameter of the outer sleeve to the length of the part of the outer sleeve which serves for receiving a rod-like adhesive mass which is larger than 1:3, thus for example 1:5 or even higher, the rod-like adhesive mass is inevitably separated, that is to say a part is retracted with the receiving holder of the piston, whilst the upper part is no longer transported. Although thus already for many years there has existed a demand for long, thin glue sticks in the configuration shape of pens, until today one has not succeeded in offering such glue sticks.

BRIEF SUMMARY OF THE INVENTION

It is therefore the object of the present invention to provide a glue stick of the initially mentioned type which is relatively long and relatively thin and has roughly the dimensions of a writing pen without at the same time the mentioned problems occuring.

This object is achieved with a glue stick with the features of an outer sleeve open at least on a first end of the glue stick, for receiving a rod-like adhesive mass; a threaded spindle connected to a rotary cap which is arranged on a second end of the glue stick and which is in interactive connection with the threaded spindle; and a piston running on the threaded spindle and which with respect to the outer sleeve is rotationally secured so that a rotary actuation of the rotary cap effects an axial displacement of the piston. The ratio of the inner diameter ($A_d$) of the outer sleeve to the length ($A_L$) of a part of the outer sleeve which serves for receiving the rod-like adhesive mass lies in the region of 1:6 to 1:15. Thanks to the special shaping of the threaded spindle which here carries out a double function, specifically on the one hand the conventional function as a screw member for moving the piston and on the other hand in that the threaded spindle simultaneously is configured as a conveyor worm, the rod-like adhesive mass is actuated from the inside practically over the whole length.

In principle the threaded spindle or conveyor worm may have various embodiment forms. With the considerably longer configuration of the threaded spindle as a conveyor worm one must however take into account the fact that the adhesion forces with larger lengths of the rod-like adhesive mass increase in a relative manner. At the same time there exists the danger of a bending or even bending-breakage of the threaded spindle. In order to avoid this, it is advantageous to shape the threaded spindle such that the ratio of spindle core diameter to spindle inner diameter lies above 1:1.5, preferably between 1:1.8 and 1:3. In order to achieve favorable transport conditions it is advantageous to select the ratio of the thread depth of the threaded spindle to the inner radius of the outer sleeve between 1:3 to 1:10 in order to achieve a suitable perfect transport.

Furthermore it has been shown to be advantageous to configure the piston which runs on the threaded spindle with a receiving holder on the adhesive side and on the side of the rotary cap with a threaded sleeve. This threaded sleeve may thanks to a suitable length serve to stabilize the threaded spindle from bending-breakage. Preferably this is achieved when the length of the threaded sleeve is at least approximately three to six times the nominal diameter of the threaded spindle.

Further advantageous embodiment forms and their significance and manner of acting inasmuch as they have not yet been explained, are to be deduced from the subsequent description.

DETAILED DESCRIPTION OF THE INVENTION

Figure 1:
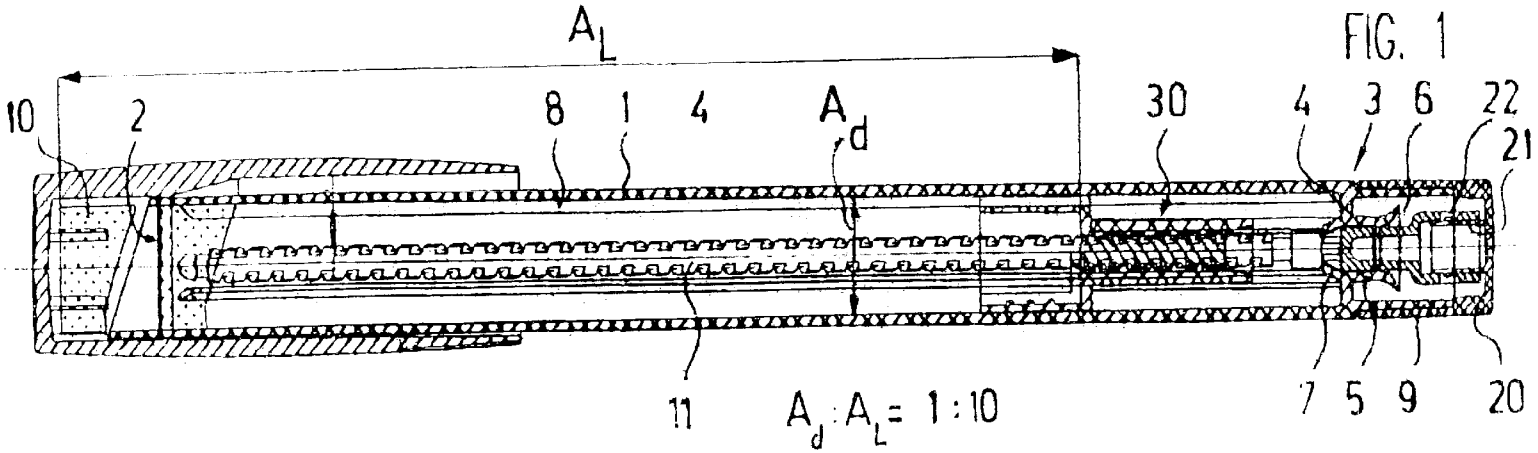
FIG. 1 shows an axial longitudinal section through the glue stick according ot the invention in the assembled condition in the completely filled condition.
Figure 2:
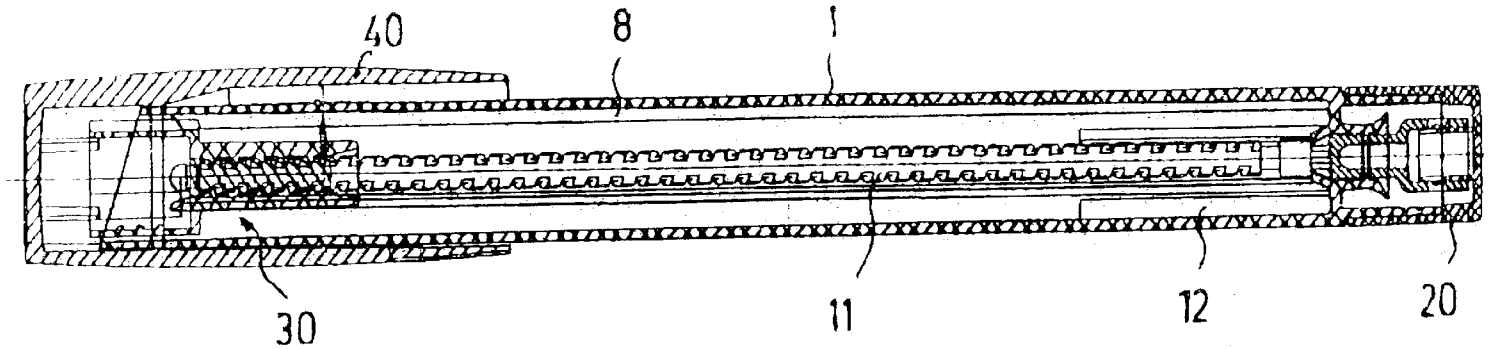
FIG. 2 shows the same representation as in FIG. 1 in the completely spent condition.

With reference to the FIGS. 1 and 2 firstly the outer sleeve which is indicated with the reference numeral 1 is described in detail. The outer sleeve 1 is a plastic tube which comprises an open end 2 in which the rod-like adhesive is slidingly held in a manner such that it may be introduced and led out, and, as shown here may be pushed out of the outer sleeve 1 for use. In order not to burden the drawing unnecessarily, the rod-like adhesive mass 10 is only indicated in the region of the open end 2. This extends however up to below into the receiving holder of the piston which is yet to be described. Opposite the one end 2 the outer sleeve 1 is closed off at the end 3 on the side of the rotary cap by a closure wall 4, wherein however this closure wall is passed through centrically by a bearing sleeve 5. On assembly the threaded rod or spindle 11 is introducible through the bearing sleeve 5. Accordingly the bearing sleeve 5 at the end 3 on the side of the rotary cap comprises a conically widened introduction 6, whilst on the side of the adhesive mass there are present resiliently acting retaining lips 7 running conically together from the closure wall 4 towards the open end 2. The treaded rod or spindle 11 has a shaping which guarantees practically a play-free mounting in the bearing sleeve 5.

The inner diameter of the outer sleeve is indicated at $A_d$, whilst the length of the part of the outer sleeve 1 which serves for receiving a rod-like adhesive mass is indicated in the figure at $A_L$. This ratio in the drawing is about 1:10. Usefully this ratio may lie roughly in the region of 1:6 to 1:15. If this ratio falls below the amount 1:6 then the glue stick becomes cumbersome, if in contrast the ratio exceeds the amount 1:15 then there is hardly any stability of the threaded spindle which here simultaneously is configured as a conveyor worm.

Furthermore on the outer sleeve 1 on its inner side there are attached a certain number of guide ribs 8, wherein in the present case there are three guide ribs, wherein only the upper guide rib which per se lies in the plane of section, is indicated, wherein however the guide rib 8 itself in not shown sectioned. The outer sleeve 1 comprises a concentric annular wall standing perpendicular on the closure wall and serves as a bearing sleeve 9 for a rotary cap 20. The rotary cap 20 is connected to the threaded spindle 11 with a positive fit. For this the rotary cap 20 has a concentric inner annular wall 21 with retaining cams 22.

In the end position according to FIG. 2 in the outer sleeve 1 in the region of the end 3 on the side of the rotary cap there are recognizable centering ribs 12. These serve for supporting the threaded sleeve of the piston in this region and simultaneously have the function as a retreat abutment of the piston in the lower end position. In this lower end position on screwing out there also occurs the largest forces since in this condition the largest possible adhesion forces between the rod-like adhesive mass 10 and the outer sleeve 1 occur. The more the rod-like adhesive mass becomes used up, the smaller is the contact surface between the rod-like adhesive mass 10 and the outer sleeve 1 and accordingly the sum of the adhesion forces becomes reduced. Therefore an additional guiding by way of the centering ribs 12 in the lower region is sufficient. If the piston 30 is located in the end position according to FIG. 2, the forces occurring at the threaded spindle are only very small.

Figure 3:
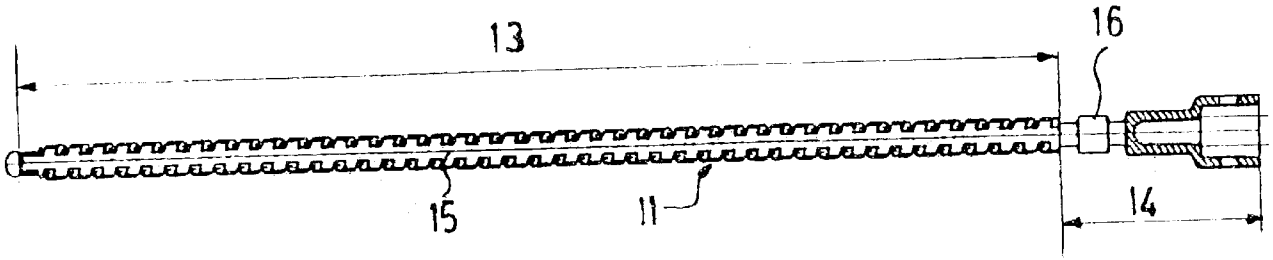
FIG. 3 shows a lateral view of the threaded spindle with a terminal coupling piece in section.
Figure 4:
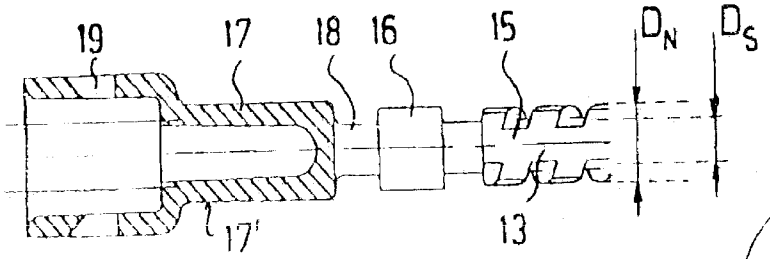
FIG. 4 shows the end region of the threaded spindle on a larger scale.

With respect to the configuration of the threaded spindle 11, FIGS. 3 and 4 are referred to. The threaded spindle 11 consists essentially of a region 13 provided with a thread and a coupling region 14 facing towards the rotary cap. The special configuration of the region 13 provided with the thread may be recognized most clearly in the enlarged detail drawing of FIG. 4. The nominal diameter of the threaded spindle 111 is indicated at $D_N$, whilst the spindle core diameter is indicated at $D_S$. In the example shown, the ration of the spindle core diameter $D_S$ to the spindle nominal diameter $D_N$ is about 1:2. This ratio is selected such that for the consistency of the adhesive mass common here, the threaded spindle the threaded spindle may act as a conveyor worm. The ratio at the same time is directly related to the cohesion force of the adhesive mass. With the adhesive masses usual here the ratio of the spindle core diameter to the spindle nominal diameter should lie above 1:1.5. Even more preferred the ratio however lies between 1:1.8 and 1:3. As has already been mentioned earlier the thread depth of the threaded spindle should also have a certain ration to the inner radius of the outer sleeve. Experimental values have shown that this ratio lies preferably between 1:3 and 1:10. For reasons with regard to manufacturing technology the threaded spindle 11 in the region 11 in the region 13 is flattened on two opposite sides down to the core of the spindle. This configuration shape which is usual is only due to reasons of manufacturing technology is order to retain as simple as possible tools. The flattened sides run exactly in the opening direction of the injection mouldings moulds.

Subsequently at the region 13 provided with a thread there is present on the side of the rotary cap a coupling region 14. Between the actual coupling part 17 and the region 13 provided with the thread there is present a smooth shank 18 which is provided with an annular thickening 16 on which with pressure there bears the retaining lips 7 of the bearing sleeve 5 in the assembled condition. The coupling part 17 has the shape of a sleeve-like body open at one side several radially outwardly directed openings 19. Through these openings at one side with several radially outwardly directed openings 19. Through these openings there engage the earlier mentioned cams 22 which are formed on the outer surface of the inner annular wall 21 of the rotary cap 20.

Figure 5:
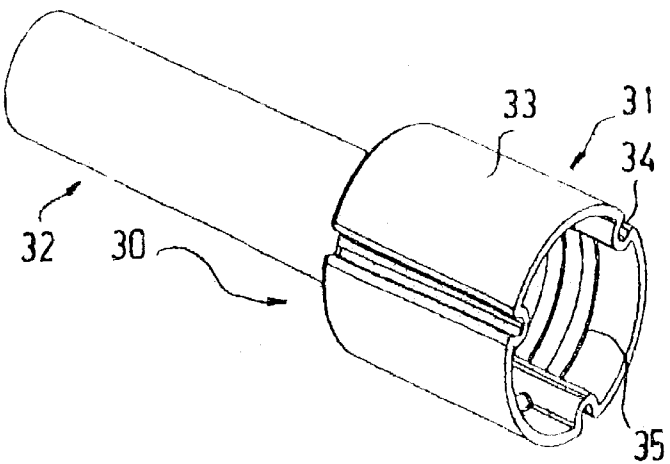
FIG. 5 shows a perspective representation of the piston with a view of the receiving holder.
Figure 6:
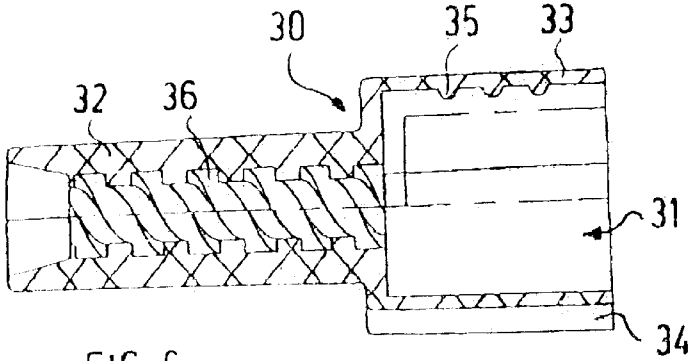
FIG. 6 shows an axial longitudinal section through the piston according to FIG. 5.

Finally in the FIGS. 5 and 6 the entirety of the piston indicated at 30 is shown. The piston 30 has two main components, which however are manufactured as one piece. Thus the piston 30 consists of a receiving holder 31 and of a threaded sleeve 32. In the receiving holder 31 there is held the rod-like adhesive mass 10 which here is not shown. The receiving holder 31 has a cylindrical holder wall 33 in which the 3 axially running guide grooves 34 are admitted. These guide grooves 34 serve for receiving the already mentioned guide ribs 8 on the inner surface of the outer sleeve 1. In order to achieve an improved mounting of the rod-like adhesive mass in the receiving holder 31 there runs the threaded sleeve 32. Its inner thread 36 is of course adapted to the outer thread of the threaded spindle 11. The threaded spindle 11 in the assembled condition passes through the threaded sleeve 32. Whilst with known embodiments usually the threaded sleeve 32 only passes through the receiving holder 31 in the region of the receiving holder 31 here these elements are arranged behind one another. This on the one hand is necessary since the diameter of the receiving holder 31 is considerably smaller than with the known embodiments and thus the portion of adhesive mass which would have space in the receiving holder would only be very small, but more important is the fact that the threaded sleeve 32 with respect to conventional solutions may be configured considerably longer. By way of this the threaded sleeve assumes the function of a bending-breakage stabilization. Whilst with conventional designs the length of the threaded sleeve is roughly twice the nominal diameter $D_N$ of the threaded spindle, thanks to the embodiment form selected here the length of the threaded sleeve may correspond to three to six times the nominal diameter of the threaded spindle.

Finally of course via the open end 2 of the outer sleeve 1 there may be attached a push-on cap 40 which gives the glue stick according to the invention thus also externally practically the appearance of a writing pen.

LIST OF REFERENCE NUMERALS

| | |
|---|---|
| $A_L$ | length of the part of the outer sleeve for receiving the adhesive mass |
| $A_d$ | inner diameter of the outer sleeve |
| $D_S$ | spindle core diameter |
| $D_N$ | spindle nominal diameter |
| 1 | outer sleeve |
| 2 | open end of the outer sleeve |
| 3 | end on the side of the rotary cap |
| 4 | closure wall |
| 5 | bearing sleeve |
| 6 | conical introduction |
| 7 | retaining lips |
| 8 | guide lips |
| 9 | bearing sleeve for the rotary cap |
| 10 | rod-like adhesive mass |
| 11 | threaded spindle |
| 12 | centering ribs |
| 13 | region provided with a thread |
| 14 | coupling region |
| 15 | spindle core |
| 16 | annular thickening |
| 17 | coupling part |
| 18 | smooth shank |
| 19 | openings |
| 20 | rotary cap |
| 21 | inner annular wall |
| 22 | retaining cams |
| 30 | piston |
| 31 | receiving holder |
| 32 | threaded sleeve |
| 33 | holder wall |
| 34 | guide grooves |
| 35 | retaining ribs |
| 40 | push-on cap |

What is claimed is:

1. A glue stick comprising:

(a) an outer sleeve for receiving a rod-like adhesive mass, the outer sleeve being open at a first end of the glue stick and being closed at a second end of the glue stick by a closure wall through which a bearing sleeve passes having tapered retaining lips provided on an end of the bearing sleeve and extending toward the first end of the glue stick and a conically widened introduction on the other end of the bearing sleeve offset from the closure wall and being surrounded by an outer bearing sleeve extending from the closure wall;

(b) a threaded spindle mounted through the bearing sleeve and being interactively connected to a rotary cap arranged on the outer bearing sleeve of the second end of the glue stick, wherein the threaded spindle is attached to an annular thickening which, in the assembled condition, is retained by the retaining lips; and (c) a piston running on the threaded spindle, the piston being rotationally secured with respect to the outer sleeve so that a rotary actuation of the rotary cap effects an axial displacement of the piston, wherein the piston comprises a receiving holder facing the first end of the glue stick and a threaded sleeve facing the second end of the glue stick, and wherein the rod-like adhesive mass extends within the receiving holder to contact the threaded spindle, wherein the ratio of the inner diameter ($A_d$) of the outer sleeve to the length ($A_L$) of a part of the outer sleeve which serves for receiving the rod-like adhesive mass lies in the region of 1:6 to 1:15 and the threaded spindle is configured as a conveyor worm in order to transport the rod-like adhesive mass in the outer sleeve in an advancing or retreating manner.

2. The glue stick according to claim 1, wherein the threaded spindle is configured such that the ratio of the spindle core diameter ($D_S$) to the spindle inner diameter ($D_N$) lies above 1:1.5.

3. The glue stick according to claim 2, wherein the ratio of the spindle core diameter ($D_S$) to the spindle inner diameter ($D_N$) lies between 1:1.8 and 1:3.

4. The glue stick according to claim 1, wherein the ratio of the thread depth of the threaded spindle to the inner radius of the outer sleeve lies between 1:3 and 1:10.

5. The glue stick according to claim 1, wherein the threaded sleeve is configured as a bending-breakage stabilization of the threaded spindle.

6. The glue stick according to claim 5, wherein the length of the threaded sleeve corresponds at least approximately 3 to 6 times the nominal diameter ($D_N$) of the threaded spindle.

7. The glue stick according to claim 1, wherein the outer sleeve at the first end of the glue stick is closable with a push-on cap.

8. The glue stick according to claim 1, wherein in the outer sleeve in the region of the second end of the glue stick there are provided centering ribs which support the threaded sleeve in this region and simultaneously serve as an abutment of the piston in the lower end position.

9. The glue stick according to claim 1, wherein the receiving holder of the piston is axially flush with the threaded sleeve of the piston.

* * * * *